US008028673B2

(12) United States Patent
Olsen et al.

(10) Patent No.: US 8,028,673 B2
(45) Date of Patent: Oct. 4, 2011

(54) FUEL LINE PROTECTIVE COVER

(76) Inventors: Paul Frederick Olsen, Chillicothe, IL (US); William Lyle Schell, Morton, IL (US); Eric James Charles, Peoria, IL (US); Christine Cronin McKay, Peoria Heights, IL (US)

( * ) Notice: Subject to any disclaimer, the term of this patent is extended or adjusted under 35 U.S.C. 154(b) by 461 days.

(21) Appl. No.: 12/230,525

(22) Filed: Aug. 29, 2008

(65) Prior Publication Data

US 2009/0107450 A1 Apr. 30, 2009

Related U.S. Application Data

(60) Provisional application No. 61/001,092, filed on Oct. 31, 2007.

(51) Int. Cl.
*F02B 77/04* (2006.01)

(52) U.S. Cl. ..... 123/198 D; 123/198 E; 180/232

(58) Field of Classification Search ..... 123/195 C, 123/198 D, 198 E; 180/232
See application file for complete search history.

(56) References Cited

U.S. PATENT DOCUMENTS

| | | | | |
|---|---|---|---|---|
| 3,402,703 | A | 9/1968 | Dickerson et al. | |
| 5,492,086 | A | 2/1996 | Kuhns | |
| 6,206,604 | B1 | 3/2001 | Dembowsky et al. | |
| 6,340,019 | B1 | 1/2002 | Eshleman et al. | |
| 6,732,717 | B2 | 5/2004 | Braun et al. | |
| 6,817,337 | B1 | 11/2004 | Siring et al. | |
| 7,063,074 | B2 | 6/2006 | Horibe et al. | |
| 7,392,782 | B2 * | 7/2008 | Fujii | 123/195 C |
| 2004/0211382 | A1 * | 10/2004 | Uruno et al. | 123/195 C |
| 2006/0070599 | A1 * | 4/2006 | Nonogaki et al. | 123/195 C |
| 2007/0012501 | A1 | 1/2007 | Frank et al. | |
| 2007/0277772 | A1 * | 12/2007 | Tanaka et al. | 123/198 E |

FOREIGN PATENT DOCUMENTS

JP 2003172202 A * 6/2003

* cited by examiner

*Primary Examiner* — Noah Kamen
(74) *Attorney, Agent, or Firm* — Finnegan, Henderson, Farabow, Garrett & Dunner LLP

(57) ABSTRACT

A fuel line protective cover is disclosed. The fuel line protective cover includes a first leg configured to be mounted to a top surface of an engine and configured to extend the length of an engine. The fuel line protective cover further includes at least one second leg configured to be mounted to a side surface of an engine. The first leg and the at least one second leg cooperate to at least partially enclose a high pressure fuel system.

20 Claims, 3 Drawing Sheets

FUEL LINE PROTECTIVE COVER

CROSS-REFERENCE TO RELATED APPLICATION

This application claims the benefit of U.S. Provisional Application No. 61/001,092, filed Oct. 31, 2007, which is incorporated herein by reference in its entirety.

TECHNICAL FIELD

The present disclosure is directed towards a fuel line protective cover and, more particularly, to a fuel line protective cover for a power system.

BACKGROUND

High pressure fuel systems supplying fuel to an internal combustion engine are becoming more common and are used to help meet stringent exhaust emission requirements. The high pressure fuel system typically includes a fuel pumping arrangement, a common manifold that extends from the pumping arrangement across the top or side of the engine, and individual fuel lines that extend from the manifold to individual fuel injectors. These systems, although successful in their intended purpose, are subject to damage. Impact damages sustained during manufacturing, operation, or servicing can cause fuel lines to weaken and potentially rupture. If ruptured, fuel lines can spray pressurized fuel onto the engine, onto the turbocharger, and into the environment. Pressurized fuel on a hot engine can pose a particularly dangerous risk of fire.

U.S. Patent Application Publication No. US2007/0012501 A1 ('501 publication) to Frank et al. published on Jan. 18, 2007 discloses a protective device for fluid lines which are laid in the engine compartment of vehicles and situated in the crash-induced displacement region of the engine. More specifically, the '501 publication discloses a protective cap which covers a corner region of the engine facing the passenger compartment. The protective cap is fitted onto the engine and is supported in a three-dimensional manner with formations which cover protrusions and projections of the engine such as, for example, cylinder head ribbings. The protective cap includes a roof surface which connects to a longitudinal limb and a transverse limb, and overlaps the corner region of the cylinder head cover. The protective cap further includes a fastening arm which is screw fastened with respect to the longitudinal side wall of the engine.

Although prior devices provide an improved mechanism to protect fuel lines from damage, the present disclosure may provide increased safety and additional user benefits.

SUMMARY

One aspect of the present disclosure is directed towards a fuel line protective cover. The fuel line protective cover includes a first leg configured to be mounted to a top surface of an engine and configured to extend the length of an engine. The fuel line protective cover further includes at least one second leg configured to be mounted to a side surface of an engine. The first leg and the at least one second leg cooperate to at least partially enclose a high pressure fuel system.

Another aspect of the present disclosure is directed towards a method for protecting a high pressure fuel system. The method includes forming a fuel line protective cover having a generally L-shaped configuration. The method further includes mounting a first leg of the fuel line protective cover along the length of the top surface of an engine, and mounting a second leg of the fuel line protective cover over at least a portion of a side surface of the engine. The method also includes enclosing at least a portion of a high pressure fuel system between the protective cover and engine.

DETAILED DESCRIPTION

Figure 1:
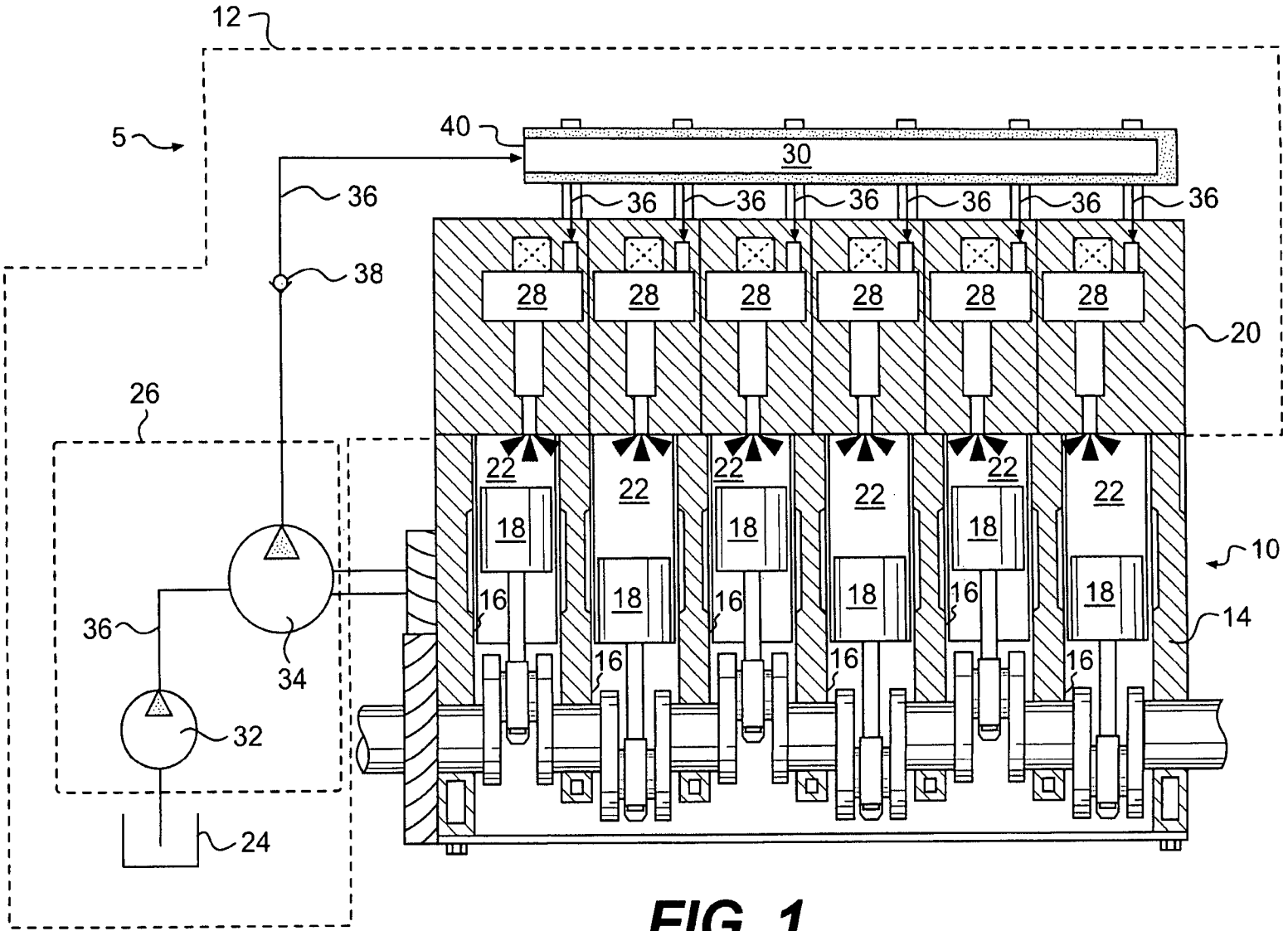
FIG. 1 is a schematic and diagrammatic illustration of an exemplary disclosed power system.

FIG. 1 illustrates a power system 5 having an internal combustion engine 10 connected to an exemplary fuel system 12. One skilled in the art would recognize that engine 10 may be any type of internal combustion engine such as, for example, a diesel engine, a gasoline engine, a gaseous fuel powered engine, a heavy fuel engine, or any other type of engine apparent to one skilled in the art.

Engine 10 may include an engine block 14 that defines a plurality of cylinders 16, a piston 18 slidably disposed within each cylinder 16, and a cylinder head 20 associated with the cylinders 16. Cylinder 16, piston 18, and cylinder head 20 may form a combustion chamber 22. In the illustrated embodiment, engine 10 includes six combustion chambers 22. However, engine 10 may include a greater or lesser number of combustion chambers 22. Furthermore, combustion chambers 22 may be disposed in an "in-line" configuration, "V" configuration, or any other suitable configuration.

Fuel system 12 may include components that deliver injections of pressurized fuel into each combustion chamber 22 of engine 10. Specifically, fuel system 12 may include a tank 24 configured to hold a supply of fuel, and a fuel pumping arrangement 26 configured to pressurize fuel and direct the pressurized fuel to a plurality of fuel injectors 28 via a common manifold 30.

Fuel pumping arrangement 26 may include one or more pumping devices that function to increase the pressure of the fuel and direct one or more pressurized streams of fuel to common manifold 30. In one example, fuel pumping arrangement 26 may include a low pressure source 32 and a high pressure source 34 disposed in series and fluidly connected by way of a fuel line 36. Low pressure source 32 may embody a transfer pump configured to provide low pressure feed to high pressure source 34. High pressure source 34 may be configured to receive the low pressure feed and to increase the pressure of the fuel. High pressure source 34 may be connected to common manifold 30 by way of a fuel line 36. A check valve 38 may be disposed within fuel line 36 to provide for one-directional flow of fuel from fuel pumping arrangement 26 to common manifold 30.

Common manifold 30 may be configured to distribute fluid to each of the fuel injectors 28 and may include an inlet 40 in communication with fuel line 36. It is contemplated that multiple common manifolds 30 may be included within each power system 5, each common manifold 30 distributing fluid to fuel injectors 28 associated with separate banks of combustion chambers 22.

Figure 2:
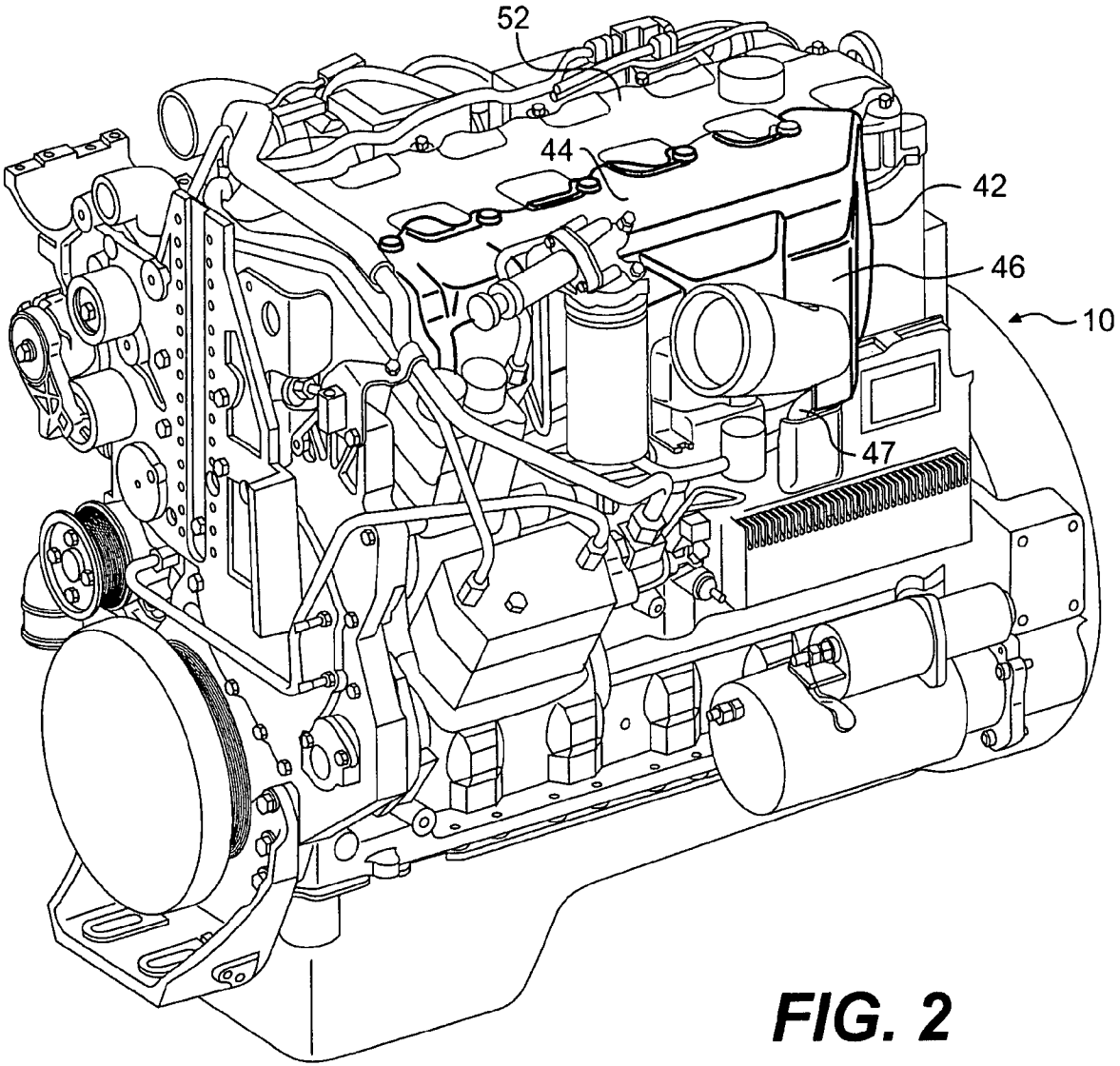
FIG. 2 is a diagrammatic view of an engine assembly having a fuel line protective cover according to an exemplary disclosed embodiment.

FIG. 2 illustrates an exemplary embodiment of engine 10 having a fuel line protective cover 42. In particular, fuel line protective cover 42 may include a first leg 44 and at least one second leg 46. First leg 44 of fuel line protective cover 42 may be configured to be mounted to a top surface of engine 10 and configured to extend the length of engine 10. At least one second leg 46 may be configured to be mounted to a side surface of engine 10, and cooperate with first leg 44 to at least partially enclose fuel system 12. More specifically, fuel line protective cover 42 may be configured to enclose common manifold 30 and fuel lines 36 in communication with common manifold 30 of fuel system 12. Fuel line protective cover 42, may thereby protect high pressure fuel lines 36 from impact damage. It is contemplated that fuel line protective cover 42, may to at least some extent, additionally deflect sprayed fuel away from other areas of engine 10.

It is noted that first leg 44 and the at least one second leg 46 of fuel line protective cover 42 may form a generally L-shaped configuration as shown in FIG. 2. Second leg 46 of fuel line protective cover 42 may not extend across an entire side of engine 10. Thus, it is contemplated that service to other components of engine 10 may be unhindered by fuel line protective cover 42. In one embodiment, the length of the second leg 46 of fuel line protective cover 42 may enclose the main wire harness 47 that extends down the length of the engine 10. In another embodiment, fuel line protective cover 42 may include L-shaped ribbings 50 (FIG. 3) at some locations to provide stiffening and prevent the cover from bowing upon impact.

Fuel line protective cover 42 may be configured to be mounted onto engine 10 in a press-fit relationship. In particular, fuel line protective cover 42 may include at least one recess 48 in first leg 44 of fuel line protective cover 42. Recesses 48 within fuel line protective cover 42 may be retained by valve cover bolts (not shown) of valve cover assembly 52 mounted on the top surface of engine 10. In this manner, fuel line protective cover 42 may be mounted in an easily removable fashion and can shorten service times. In one example, it is contemplated that at least one recess 48 may be a hex-shaped recess 48 in the fuel line protective cover 42. The hex-shaped recesses 48 may be press-fit onto the heads of the hex-shaped valve cover bolts.

In another embodiment, recesses 48 may include embedded magnets (not shown). In this manner the fuel line protective cover 42 may be pressed over the valve cover bolts and held in place by a deformation of the recesses 48 or by magnetic attraction. In still another embodiment, fuel line protective cover 42 may be held in place by one or more ball-shaped protrusions formed on engine 10. That is, fuel line protective cover 42 may include recesses, spherical in shape, having an opening smaller than the main recess diameter. The opening may deform as the cover is pressed into place, and return to its original shape after the ball protrusion is seated in the recess. It is contemplated that fuel line protective cover 42, may be press-fit onto engine 10 by any other manner known to one skilled in the art. In another embodiment fuel line protective cover 42 may be fastened in place using traditional fasteners, e.g., bolts, screws, etc.

Figure 3:
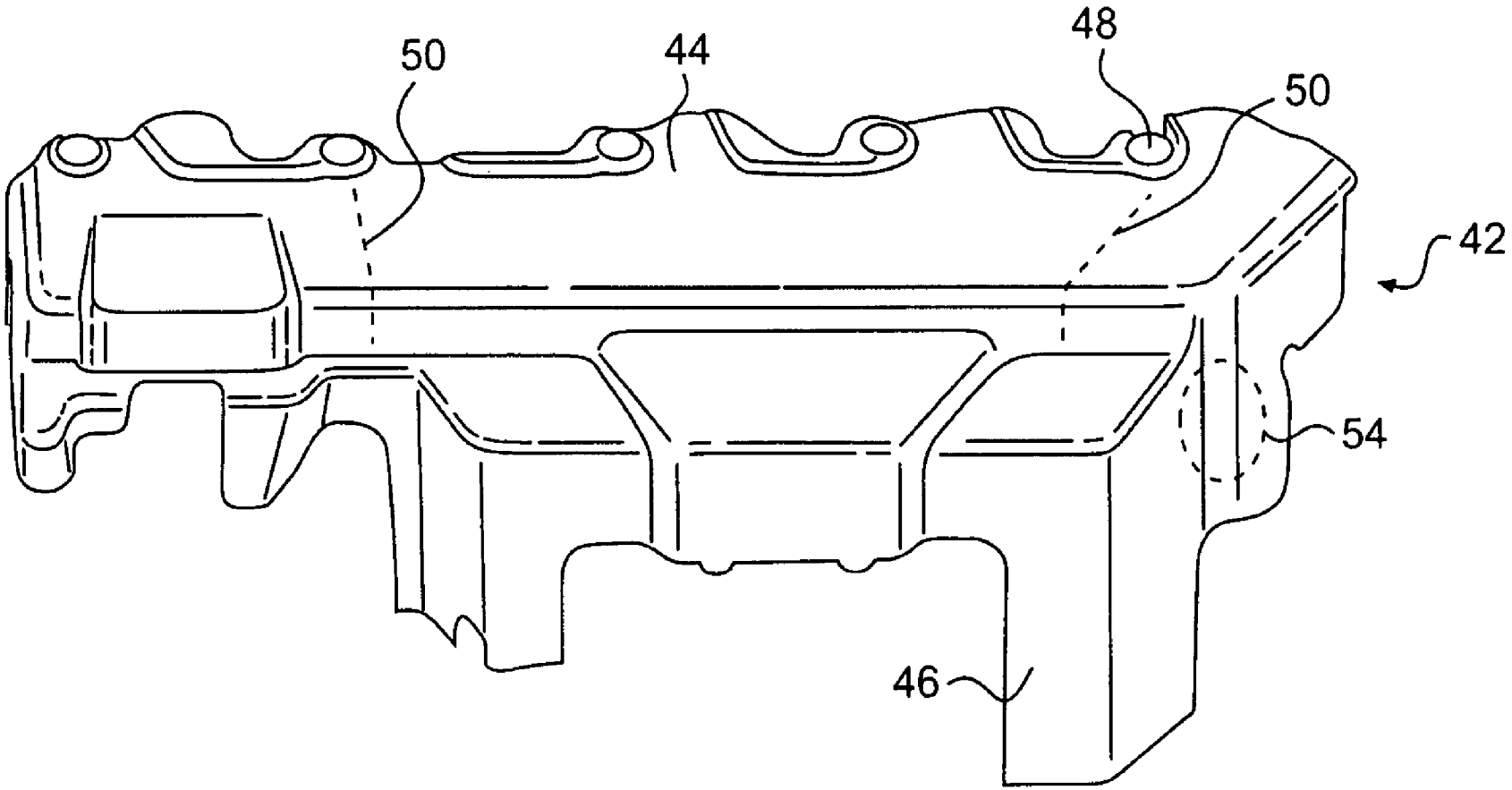
FIG. 3 is a diagrammatic view of an exemplary fuel line protective cover.

Referring to FIG. 3, fuel line protective cover 42 may be fabricated, e.g., from plastic, as a one-pieced molded structure. Other materials, e.g., composites, various metals, etc., are contemplated. In one embodiment, fuel line protective cover may include perforations, indentions, and/or other markings 54 to enable the fuel line protective cover 42 to be customized for different engine arrangements. It is contemplated that the various indentations and/or perforations 54 can accommodate various original equipment manufacturer (OEM) applications, and a particular fuel line protective cover 42 may be readily adapted to different engine configurations.

INDUSTRIAL APPLICABILITY

The fuel line protective cover of the present disclosure has wide applications in a variety of engine types including, for example, diesel engines, gasoline engines, gaseous fuel-powered engines, and heavy fuel engines. The disclosed fuel line protective cover may be employed in any engine that utilizes a common manifold for distributing pressurized fluid. The fuel line protective cover may protect the fuel system from tampering and accidental damage.

Referring to the exemplary embodiment illustrated in FIG. 2, fuel line protective cover 42 having a generally L-shaped configuration, may be mounted onto a top surface and a side surface of engine 10. More specifically, first leg 44 of fuel line protective cover 42 may be mounted along the length of the top surface of engine 10. At least one second leg 46 of fuel line protective cover 42 may be mounted over at least a portion of a side surface of engine 10. First leg 44 and second leg 46 of fuel line protective cover 42 may enclose at least a portion of fuel system 12 between fuel line protective cover 42 and engine 10.

Fuel line protective cover 42 may be press-fit onto engine 10. For example, fuel line protective cover 42 may include recesses 48. Recesses 48 within the fuel line protective cover 42 may press-fit onto heads of engine valve cover bolts of the valve cover assembly 52. In this way, fuel line protective cover 42 may be mounted in an easily removable fashion.

Fuel line protective cover 42 may be configured to partially enclose fuel system 12. For example, fuel line protective cover 42 may be configured to at least partially enclose common manifold 30 and a plurality of fuel lines 36 in communication with common manifold 30, thereby protecting common manifold 30 and fuel lines 36 from impact or accidental damage sustained during manufacturing, operation, or servicing. In addition, fuel line protective cover 42 may, in the event of fuel system damage and/or leakage, confine any spray of fuel and prevent fuel from spraying onto components associated with engine 10.

It will be apparent to those skilled in the art that various modifications and variations can be made to the disclosed fuel line protective cover without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed:

1. A fuel line protective cover, comprising:

a first leg configured to be mounted to a top surface of an engine and configured to extend the length of the engine;

at least one second leg, configured to be mounted to a side surface of an engine, wherein the first and the at least one second leg form a generally L-shaped configuration and cooperate to at least partially enclose a common manifold of a high pressure fuel system.

2. The fuel line protective cover of claim 1, wherein the protective cover is further configured to enclose a plurality of fuel lines in communication with the common manifold.

3. The fuel line protective cover of claim 2, wherein the protective cover is configured to protect high pressure fuel lines from impact.

4. The fuel line protective cover of claim 1, wherein the protective cover is configured to at least partially cover a main wire harness extending the length of the engine.

5. The fuel line protective cover of claim 1, wherein the first and second legs are fabricated as a one-piece molded structure.

6. The fuel line protective cover of claim 5, wherein the first and second legs include perforations, indentions, and/or markings to enable the protective cover to be customized for different engine arrangements.

7. The fuel line protective cover of claim 1, wherein at least one of the first and second legs includes stiffening ribs.

8. The fuel line protective cover of claim 1, wherein the first and second legs are fabricated from plastic.

9. The fuel line protective cover of claim 1, wherein the first and second legs are configured to be mounted to the engine in a press-fit relationship.

10. The fuel line protective cover of claim 9, further including at least one recess within the first leg, the at least one recess configured to secure the protective cover to at least the top surface of the engine.

11. The fuel line protective cover of claim 10, wherein the at least one recess is configured to mate with at least one valve cover bolt on the engine surface.

12. The fuel line protective cover of claim 1, wherein the at least one second leg of the protective cover does not extend across the entire side surface of the engine.

13. A method for protecting a high pressure fuel system, comprising:

forming a fuel line protective cover having a generally L-shaped configuration;

mounting a first leg of the fuel line protective cover along the length of the top surface of an engine;

mounting a second leg of the fuel line protective cover over at least a portion of a side surface of the engine;

press-fitting the protective cover to the engine, wherein press-fitting includes press-fitting recesses in the protective cover onto the heads of engine valve cover bolts; and enclosing at least a portion of a high pressure fuel system between the protective cover and the engine.

14. The method of claim 13, wherein mounting the second leg includes mounting the second leg such that the protective cover does not extend over the entire side surface of the engine.

15. A power system comprising:

an engine having a plurality of combustion chambers, a top surface, and a side surface;

a fuel system configured to provide pressurized fuel to the combustion chambers, the fuel system including a common manifold and a plurality of individual fuel lines; and a protective cover, mounted to the top surface and the side surface of the engine, extending the length of the fuel system, and configured to partially enclose the plurality of fuel lines, wherein the protective cover includes at least one fastener configured to secure the protective cover to at least the top surface of the engine, and wherein the at least one fastener engages in a press-fit relationship with at least one valve cover bolt on the top surface of the engine.

16. The power system of claim 15, wherein the protective cover includes perforations, indentions, and/or markings to enable the protective cover to be customized for different engine arrangements.

17. The power system of claim 15, wherein the protective cover is fabricated as a one-piece molded structure.

18. The power system of claim 15, wherein the protective cover includes a first leg and at least one second leg, wherein the first leg and the at least one second leg form a generally L-shaped cross-section.

19. The power system of claim 15, wherein the protective cover is fabricated from plastic.

20. The power system of claim 15, wherein the protective cover includes stiffening ribs.

* * * * *